United States Patent [19]

Le Gresley

[11] 3,934,760

[45] Jan. 27, 1976

[54] RETRACTABLE AND VENTED POURING SPOUT

[76] Inventor: Edsel Le Gresley, 170 Commander Blvd., Agincourt, Ontario, Canada

[22] Filed: Oct. 24, 1974

[21] Appl. No.: 517,792

[30] Foreign Application Priority Data

Jan. 22, 1974 Canada ..... 190653

[52] U.S. Cl. ..... 222/153; 222/478; 222/525; 222/538

[51] Int. Cl.[2] ..... B67D 3/00

[58] Field of Search ..... 222/153, 478, 499, 525, 222/538, 542, 568

[56] References Cited

UNITED STATES PATENTS

| | | | |
|---|---|---|---|
| 483,082 | 9/1892 | Payne | 222/525 UX |
| 2,841,313 | 7/1958 | Beall, Jr. | 222/568 X |
| 3,010,619 | 11/1961 | Gronemeyer et al. | 222/542 X |
| 3,155,295 | 11/1964 | Dearing | 222/525 |
| 3,172,573 | 3/1965 | Parish, Jr. et al. | 222/499 X |
| 3,173,587 | 3/1965 | Stearns | 222/525 X |

FOREIGN PATENTS OR APPLICATIONS

| | | | |
|---|---|---|---|
| 622,268 | 3/1963 | Belgium | 222/525 |
| 90,432 | 10/1958 | Netherlands | 222/525 |
| 1,208,647 | 1/1966 | Germany | 222/525 |
| 991,197 | 10/1951 | France | 222/542 |

*Primary Examiner*—Robert B. Reeves
*Assistant Examiner*—David A. Scherbel

[57] ABSTRACT

A combined closure and pouring spout assembly is disclosed. The assembly consists of an outer closure member adapted to be received within an opening provided in a container and the outer closure has an outwardly opening recess to receive a closure plug. An inner transverse wall is provided in the outer closure and defines a bottom for the recess and a circular aperture is provided in the inner transverse wall and an elongate tube in the form of a pouring spout having inner and outer ends is carried in the circular aperture. The spout has throughout a major portion of its length an outer diameter less than the diameter of the aperture whereby the spout may be moved, when the closure plug is removed, to an extended pouring position and to a retracted non-pouring position. The spout is held captive within the aperture by an annular flange provided on the outer end of the spout and by an enlargement provided on the inner end of the spout with the annular flange and enlargement having outer diameters greater than the diameters of the circular aperture. The assembly is provided with a venting arrangement provided in association with the spout to provide air ingress into the container during pouring. The spout fits loosely within the circular aperture with the closure plug in sealing position within the outer closure thus providing communication between the interior of the spout and the interior of the container.

12 Claims, 7 Drawing Figures

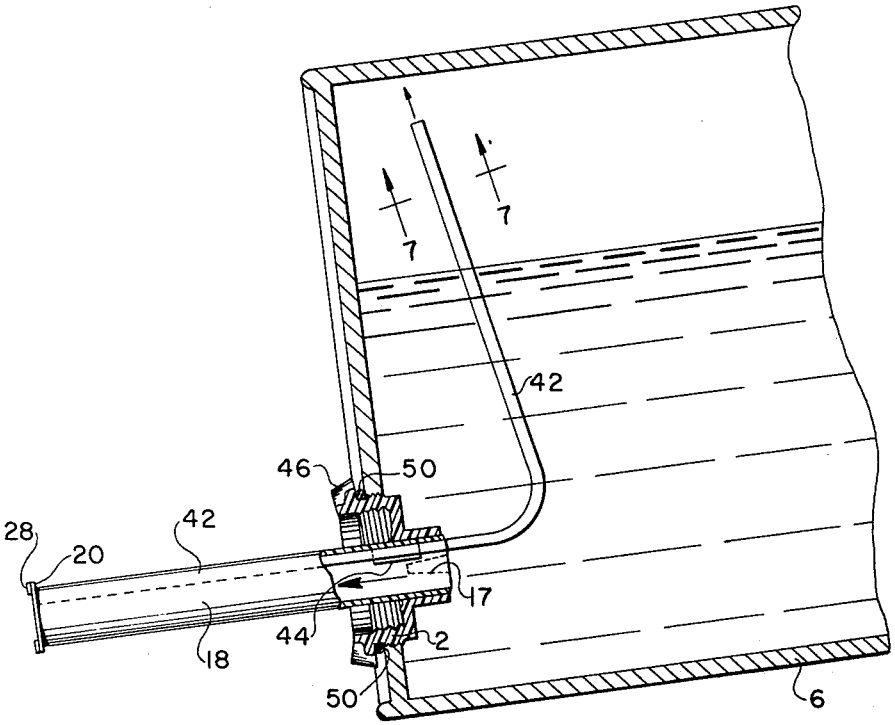
FIG. 5
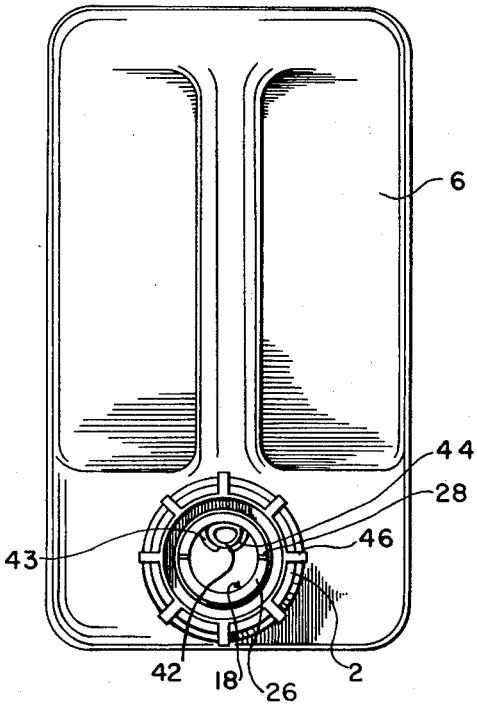
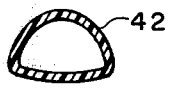
FIG. 7
FIG. 6

RETRACTABLE AND VENTED POURING SPOUT

The present invention relates to a conbined closure and pouring spout, and particularly to a combined closure for a liquid container or receptacle and an extensible and retractable pouring spout. The spout assembly incorporates an air inlet feature or air venting means to permit entry of air into the container during dispensing or pouring of liquid to avoid intermittent gushing or surging of the liquid from the container.

The surging or gushing phenomenon which occurs when one attempts to pour liquid from a container without any provision to equalize air pressures within and exteriorly of the container is well known. This phenomenon may be overcome by providing the container with a separate air inlet opening positioned some distance away from the pouting opening but such containers have the disadvantage that separate closure members are required to seal the two openings in air- and liquid-tight manner.

The present invention provides a novel construction wherein a combined closure member and extensible and retractable pouring pout includes a venting arrangement incorporated therewith, for providing smooth uniform liquid flow from the container and wherein only one opening in the container is necessary.

In known constructions of combined closures and pouring spouts where a retractable spout is at least partially immersed in liquid in the container it is a phenomenon when the container is substantially full that upon opening of the closure of the container (even when the container is upright) that sudden discharge of liquid through the spout occurs. This phenomenon is the result of air pressure differential between the air in the sealed container above the liquid and the air in the spout between the outer closure of the spout and the liquid in the spout, which occurs upon a warming of the container with resultant liquid and air expansion such as when the container is left in the sun or is moved to a warmer location. The suddent discharge of liquid through the spout upon opening of the assocuate closure (even when the container is upright and the spout substantially vertical) becomes more pronounced the higher the volatility of the liquid and while such spout discharge is an insignificant factor when the liquid is water, the spout discharge effect is critical and must be avoided when the liquid involved is gasoline or naptha or the like. The present invention completely avoids the spout discharge phenomenon by means providing equalization of air pressures between air in the spout and air in the container exterior of the spout with these means also providing pressure equalization of the air within the container with exterior atmospheric pressure immediately upon commencement of removal of the closure.

In general construction, the combined closure and pouring spout assembly consists of an outer closure member to be received by an opening provided in a receptacle or container. It is usual that the outer closure member will be provided with exterior threads to be threadably received within a threaded aperture provided in the container, although other various means of attachment such as by lug and cam securing arrangements may be used.

The outer closure is provided with a central outwardly opening generally cylindrical recess provided with interior threading to snugly receive a closure plug in threaded engagement therewith. The outer closure also has a rear radially of transversely extending wall having an aperture provided therein and additionally may have a rearwardly or inwardly projecting hollow collar or sleeve member extending inwardly from the aperture towards the receptacle interior. A length of hollow tube in the form of a pouring spout is carried in the aperture with the outer diameter of the spout throughout a major portion of its length being of a size to enable longitudinal movement of the spout through the aperture; the inner and outer ends of the spout being provided with annular beads or annular collars having outer diameters greater than the diameter of the aperture to maintain the spout captive within the aperture. In a closed non-pouring position, the spout is positioned inwardly (retracted) with respect to the aperture and the plug is threadedly positioned within the outer closure whereby the spout is held between the plug and the rear wall of the outer closure.

The diameter of the spout adjacent the innermost end may have a diameter which increases uniformly (in frusto-conical fashion) towares the innermost end whereby the spout is snugly received within the collar carried on the outer closure when the spout is in its pouring position. A venting arrangement is provided in association with the spout to permit ingress of air into the container during pouring of liquid therefrom. In one embodiment the venting arrangement is in the form of a venting aperture provided in the wall of the spout a distance from the inner end of the spout. The venting aperture is provided a distance from the inner end of the spout which is just somewhat greater than the longitudinal length of the collar carried by the outer closure whereby the venting aperture is in communication with outside atmospheric pressure during pouring. In another embodiment, the venting arrangement is in the form of a separate hollow venting tube carried within the spout and extending the length thereof to provide means for air ingress during pouring.

The collar projecting inwardly from the rear wall of the outer closure is of an internal diameter size greater than the outer diameter of the outer end of the spout so that the spout is loosely held by the collar when the spout is in retracted or non-pouring position. Additionally, the collar is provided with one or more notches or openings extending from the inner end of the collar to or substantially to the rear wall of the outer closure; and the outer surface of the flange on the outer end of the spout is provided with at least one (preferably two or more) upstanding ridges or flanges which prevent the inner surface of the inner closure from tightly sealing the outer end of the spout. These latter features provide means for eliminating the spout discharge phenomenon discussed above.

It is the main object of the present invention then to provide a combined container closure and extendable pouring spout facilitating the pouring of liquid from a container and which includes air venting means to eliminate gushing or surging of liquid from the container during pouring.

It is a further object to provide a combined container closure and extendable and retractable pouring spout including means communicating the interior of the spout with the interior of the container when the container is full or substantially full of liquid and when the container is sealed to eliminate discharge of liquid from the container as a result of air pressure differential.

The device of the invention of course provides the advantage of incorporating a pouring spout thus removing the necessity of having to provide a funnel to assist in precise and accurate pouring.

The above and other objects and advantages will become apparent from the following description taken in conjunction with the accompanying drawings wherein:

FIG. 5 is a longitudinal view, partially in section, of a further embodiment shown in position on a container in pouring position;

FIG. 6 is a front view of the embodiment shown in FIG. 5; and

FIG. 7 is a sectional view of a venting tube taken along line 7—7 of FIG. 5.

Figure 1:
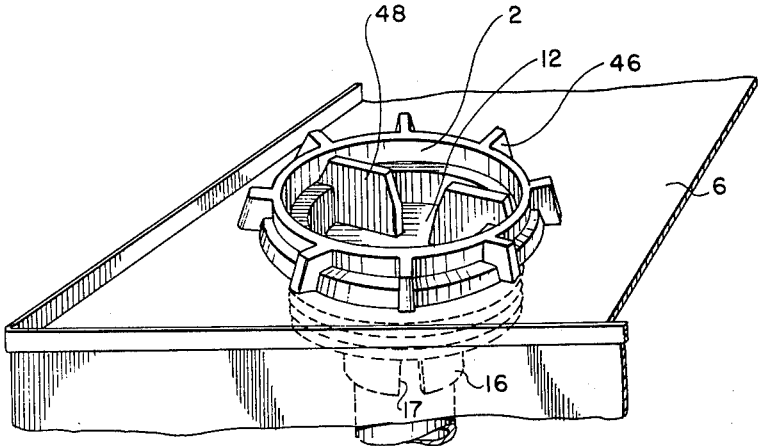
FIG. 1 is a perspective view of the combined closure and pouring spout according to the invention shown in closed position on the container or receptacle.

Referring now to the drawings in detail, numeral 2 illustrates an outer closure provided with exterior threading 4 for threaded engagement with a suitable threaded aperture (not numbered) provided in a receptacle or container 6. While the drawings illustrate the securement of the outer closure to a container 6 by means of threaded engagement, it will be appreciated that other means such as by interlocking lugs, etc., may be provided both upon the receptacle and outer closure to effect the desired securement. Moreover, the size of the outer closure 2 and the threading 4 provided thereon will be such to be received by standard threading provided on jerry-cans, 25 gallon and 45 gallon drums, etc., and other containers commonly used.

Figure 3:
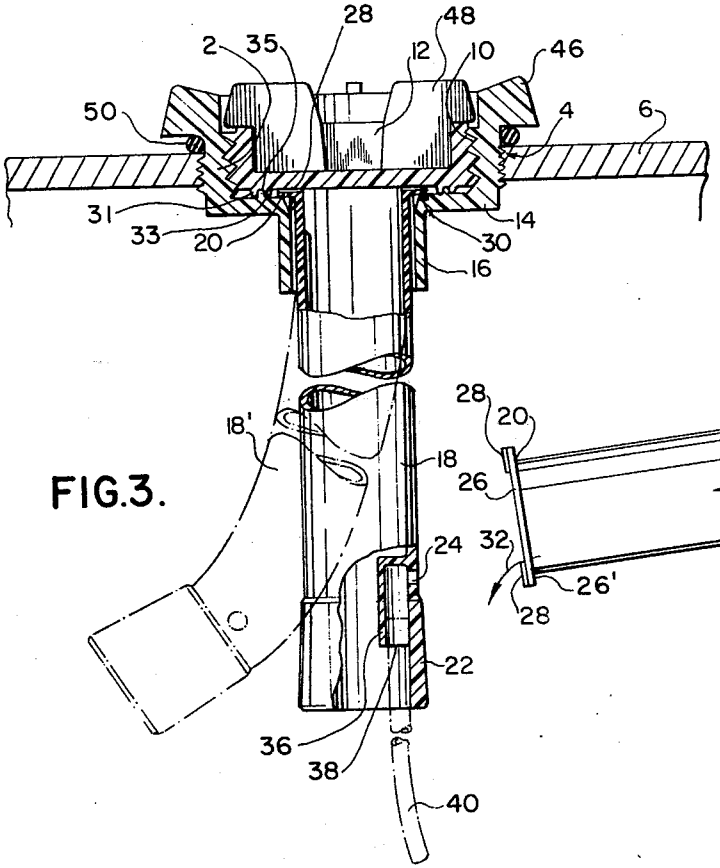
FIG. 3 is a longitudinal sectional view of one embodiment of the device mounted on a receptacle and shown in closed position.

The outer closure 2 has an inner recess 8 and interior threads 10 provided therein to threadedly receive a closure plug 12 as well shown in FIGS. 1 and 3.

The inner or rear wall 14 of the outer closure is provided with an aperture (not numbered in the drawings) and may be provided with an inwardly directed collar 16. The collar 16 is provided with at least one notch or recess 17 to enable equalization of air pressure within and without in the event that the container is completely or substantially completely filled.

A hollow tube 18 in the form of a pouring spout is carried by the collar 16 provided in the outer closure 2 with the outer end of the tube 18 being provided with an annular flange 20 and with the inner end being provided with a tower 22 of uniformly increasing diameter (preferably frusto-conical) to hold the tube captive within the collar.

Figure 2:
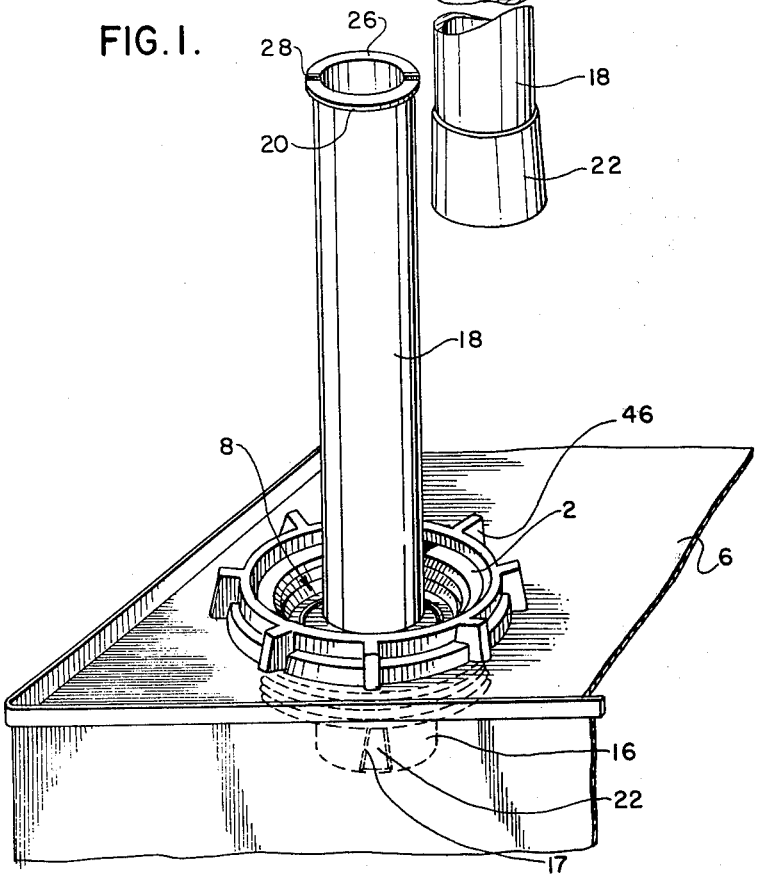
FIG. 2 is a perspective view of the device according to the present invention shown in pouring position on a container or receptacle.

The diameter of the spout 18 throughout substantially its complete length is more or less uniformly constant and is of a diameter somewhat less than the interior diameter of the collar 16 provided in the outer closure 2 with the result that the tube is longitudinally movable with respect to the outer closure so that the spout may be moved from a retracted to an extended pouring position as shown in FIGS. 1 and 2, respectively. The spout may also in one embodiment be provided with a venting aperture 24 the purpose of which will be described in more detail below. As indicated above, the collar 22 is snugly received within collar 16 when the spout is in pouring position.

Figure 4:
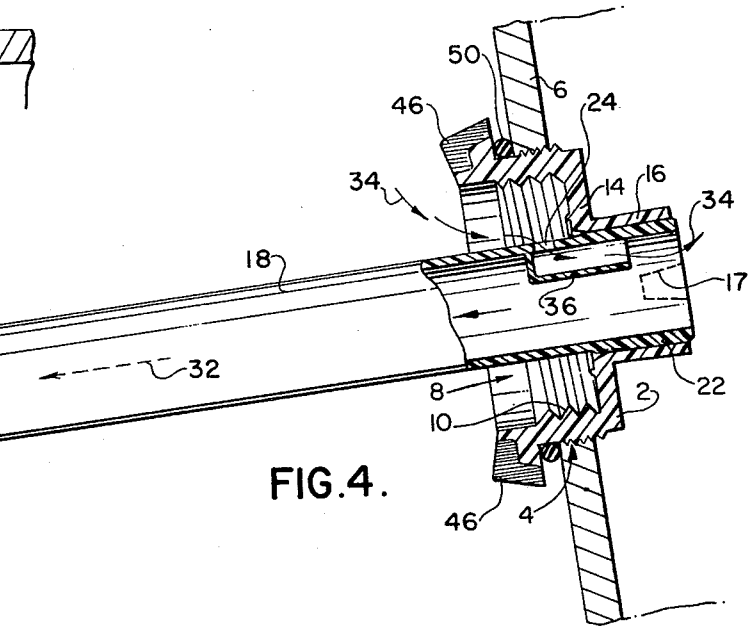
FIG. 4 is a longitudinal sectional view of the embodiment shown in FIG. 3 mounted on a container or receptacle and shown in pouring position.

This snug engagement of the inner end of the spout within the collar 16 when the spout is in pouring position is well illustrated in FIG. 4 of the attached drawings. Thus, when the spout is in pouring position and the container is tilted, liquid leaving the container 6 by way of the spout will pass directly down the spout and not between the outer surface of the spout and the interior surface of the collar.

The outer surface 26 of the annular flange 20 is provided with at least one (preferably two) upstanding ridges 28 as shown in the drawings.

When the device is to be closed, the spout 18 is pushed inwardly into the container so that the inner surface 26′ of the annular flange 20 loosely bears against the outer surface of the rear wall 14 of the outer closure, and the closure plug 12 is then threadedly inserted within the outer closure. The closure plug is provided with an inwardly directed bearing surface 30 which bears against the ridges 28 and the presence of the ridges 28 prevents a complete closure or sealing of the end of the spout 18 even when the inner closure is tightly secured within the outer closure. The seal between the flange 20 and the rear wall 14 is also incomplete so that air pressure differential is avoided as air is free to pass between the spout 18 and collar 16, between wall 14 and flange 20 and flange 20 and closure plug 12 and into the upper end of the spout 18. To positively ensure that an incomplete seal is formed between the inner surface 26′ of the flange 20, and the wall 14, ridges similar to ridges 28 could be provided (not shown) or the surface 26′ could have a shallow frusto-conical configuration (not shown) and/or the inner surface of the collar 16 adjacent the upper surface of the wall 14 could be beveled somewhat (also not shown).

As shown in the drawings in FIG. 3, the inner surface 30 of the closure plug 12 is provided with two spaced-apart inwardly projecting annular ridges 31 and 33 which when the closure plug 12 is screwed into the outer closure 2 contact and bear against an annular ridge 36 of intermediate radius carried by the closure 2. The mating of the annular ridges 31, 33 and 36 provide an air- and liquid-tight sealing of the closure plug 12 within the outer closure 2. While the drawings show the closure plug 12 as having two annular sealing rings and the outer closure as having one, it will be appreciated that this could be reversed.

The annular sealing rings 31, 33 and 35 themselves guard against a tight sealing of the outer end of the spout 18 by the closure plug 12, and the ridges 28 provide a further safeguard against such happening.

When it is desired to pour liquid from the container, the closure plug 12 is removed and the pouring spout 18 is moved outwardly with respect to the outer closure to the position shown in FIG. 4. This movement may be effected simply by inserting a finger into the outermost end of the tube and drawing the tube outwardly, or in suitable like manner.

During the pouring operation, the venting aperture 24 will be maintained in an upwardly facing position whereby fluid will leave the container as illustrated by arrow 32 in FIG. 4, and venting air will enter the container to replace the liquid as shown by arrows 34 in FIG. 4. This arrangement of a venting aperture overcomes the gushing or surging phenomenon discussed above.

If desired, the venting aperture 20 may be provided with a hollow covering 36 having an inwardly directed opening 38 as shown in FIGS. 3 and 4.

Also, while the formal drawings show the tube 18 as being substantially straight, the tube, can if desired, have a curvature such as shown in broken lines at 18' in FIG. 3; and moreover the venting arrangement 36 may be provided with an inwardly directed venting tube member 40 as shown in broken lines in FIG. 3.

A further embodiment for venting air during pouring is shown in FIGS. 5, 6 and 7. In this embodiment, the venting during pouring is accomplished by utilizing a separate venting tube 42 carried within the spout 18 by lugs 43 and 44 formed within the spout during manufacture. The tube 42 preferably extends the complete length of the spout 18 as shown in full and broken lines in FIG. 5 and may be bent as shown to achieve venting without bubble formation. Preferably, the tube 42 can have a rounded generally triangular configuration as shown in FIG. 7 with one exterior side surface having a curvature (in section) corresponding generally with the interior curvature of the spout. This venting arrangement provides for simple manufacture and also maintains the venting tube 42 from rotation relative to the spout.

The outer closure member may also be provided with additional sealing means in the form of an O-ring 50 if desired.

In the formal drawings, the closure plug 12 is shown as being threaded to be received within corresponding threading provided interiorly of the outer closure 2, but it will be appreciated that the plug could be secured within the outer closure by various means such as lugs, etc.

In a preferred form of construction, component parts of the inventive combined closure and pouring spout may be made of a synthetic resin material, such as plastic, high-impact plastic material, nylon, etc., although various or all of the components may be made from other suitable material such as metal and metal alloys.

To facilitate the positioning in and removing of the outer closure from a container, suitable lugs 46 may be provided on the outer closure. Additionally, the closure plug 12 may have raised flange members 48 as an assistance in mounting and removal.

I claim:

1. A combined closure and pouring spout assembly comprising an outer closure member to be received within an opening provided in a container, the outer closure having an outwardly opening recess to receive a closure plug, an inner transverse wall in the outer closure defining a bottom for the recess and a circular aperture provided in the inner transverse wall and an elongate tube in the form of a pouring spout having inner and outer ends carried in the circular aperture, the spout having throughout a major portion of its length an outer diameter less than the diameter of the circular aperture whereby the spout may be moved, when the closure plug is removed, to an extended pouring position and to a retracted position, the spout being held captive within the circular aperture by an annular flange provided on the outer end of the spout and by an enlargement provided on the inner end of the spout with the annular flange and enlargement having outer diameters greater than the diameter of the circular aperture, and a venting arrangement provided in association with the spout to provide air ingress into the container during pouring, the spout fitting loosely within the circular aperture with the closure plug in sealing position in the outer closure providing communication between the interior of the spout and the interior of the container the closure plug being threadedly received within the outer closure and having two annular spaced apart ridges on the bottom surface thereof for reception between an annular ridge provided on the inner transverse wall of the outer closure to effect air-and-liquid-tight sealing between the closure plug and the outer closure.

2. An assembly according to claim 1, wherein the outer closure is provided with exterior threading for threading engagement with threading provided in the opening of the container.

3. An assembly according to claim 1 including a hollow collar formed integrally with the outer closure and extending inwardly from the inner transverse wall and encircling the aperture and at least one notch in the collar extending substantially the complete length of the collar.

4. An assembly according to claim 3, the enlargement provided at the inner end of the tube being of generally frusto-conical configuration to be snugly received by said hollow collar.

5. An assembly according to claim 3 wherein the venting arrangement consists of a venting aperture provided in the wall of the spout a distance from the inner end thereof greater than the longitudinal length of the collar.

6. An assembly according to claim 5, including a cover for the venting aperture provided interiorly of the tube and an inwardly directed aperture provided in the covering.

7. An assembly according to claim 1, wherein the venting arrangement includes a venting aperture provided in the wall of the spout towards the inner end thereof.

8. An assembly according to claim 1, wherein the venting arrangement includes a venting tube carried within the spout.

9. An assembly according to claim 9 wherein the venting tube is of rounded generally triangular configuration in section carried by lugs provided in the spout.

10. An assembly according to claim 1, wherein the outer surface of the annular flange on the outer end of the spout is provided with at least one ridge against which the closure plug may bear when in closed position within the outer closure.

11. A combined closure and pouring spout assembly comprising an outer closure member to be received within an opening provided in a container, the outer closure having an outwardly opening recess to receive a closure plug, an inner transverse wall in the outer closure defining abottom for the recess and a circular aperture provided in the inner transverse wall and an elongate tube in the form of a pouring spout having inner and outer ends carried in the circular aperture, the spout having throughout a major portion of its length an outer diameter less than the diameter of the circular aperture whereby the spout may be moved, when the closure plug is removed, to an extended pouring position and to a retracted position, the spout being held captive within the circular aperture by an annular flange provided on the outer end of the spout and by an enlargement provided on the inner end of the spout with the annular flange and enlargement having outer diameters greater than the diameter of the circular aperture, and a venting arrangement provided in association with the spout to provide air ingress into the container during pouring, the spout fitting loosely within the circular aperture with the closure plug in sealing position in the outer closure providing communication between the interior of the spout and the interior of the container, including a hollow collar formed integrally with the outer closure and extending inwardly from that inner transverse wall and encircling the aperture and at least one notch in the collar extending substantially the complete length of the collar, and wherein the venting arrangement consists of a venting aperture provided in the wall of the spout a distance from the inner end thereof greater than the longitudinal length of the collar.

12. An assembly according to claim 11, including a cover for the venting aperture provided interiorly of the tube and an inwardly directed aperture provided in the covering.

* * * * *